US012016406B2

(12) United States Patent
Stenson et al.

(10) Patent No.: US 12,016,406 B2
(45) Date of Patent: Jun. 25, 2024

(54) RESPIRATORY MASK

(71) Applicants: Steven A. Stenson, Tamuning, GU (US); Yuko Stenson, Tamuning, GU (US)

(72) Inventors: Steven A. Stenson, Dededo, GU (US); Yuko Stenson, Dededo, GU (US)

( * ) Notice: Subject to any disclaimer, the term of this patent is extended or adjusted under 35 U.S.C. 154(b) by 270 days.

(21) Appl. No.: 17/221,240

(22) Filed: Apr. 2, 2021

(65) Prior Publication Data

US 2022/0071322 A1 Mar. 10, 2022

Related U.S. Application Data

(60) Provisional application No. 63/075,512, filed on Sep. 8, 2020.

(51) Int. Cl.
*A41D 13/11* (2006.01)

(52) U.S. Cl.
CPC ..... *A41D 13/1161* (2013.01)

(58) Field of Classification Search
CPC ..... A61M 16/0605; A61M 16/0683; A61M 16/06; A41D 13/1161; A41D 13/11; A41D 13/1107; A41D 13/1115; A41D 13/1123; A41D 13/113; A41D 13/1138; A41D 13/1176; A41D 13/1184; A41D 13/1192; A41D 13/1146; A41D 15/002; A62B 18/025; A62B 18/084; A62B 18/00; A62B 18/02; A62B 18/08
See application file for complete search history.

(56) References Cited

U.S. PATENT DOCUMENTS 7,044,127 B1 5/2006 Fernandez DeCastro
7,958,889 B1 6/2011 Fernandez-DeCastro
(Continued)

FOREIGN PATENT DOCUMENTS

CA 2 538 924 A1 5/2005
CN 203884739 U 10/2014
(Continued)

OTHER PUBLICATIONS

杨家元，杨阳，陈红 (Yang J, Yang Y, Chen H), "Mask with focusing respiration selective filtration", Feb. 2014, All pages (Year: 2014).*

(Continued)

*Primary Examiner* — Tarla R Patel
(74) *Attorney, Agent, or Firm* — Venable LLP

(57) ABSTRACT

A mask for covering a user's nose and mouth includes covering material and a band system. The covering material includes an upper section and a lower section and the band system includes a main band for attachment to upper side edges of the upper section, and a lower band for attachment to the lower section. The main band remains attached at all times to the upper side edges of the upper section to hold the upper section of the covering material against the user's face at all times when worn. The user maintains connection of the lower band when the lower section is to be closely held against the user's face while the mask is worn by the user, and releases connection of the lower band when the lower section of the covering material is to hang freely in front of the user's face while the mask is worn.

20 Claims, 4 Drawing Sheets

(56) References Cited

U.S. PATENT DOCUMENTS

| | | | | |
|---|---|---|---|---|
| 2010/0031962 | A1* | 2/2010 | Chiu | A41D 13/1161 128/206.19 |
| 2011/0180078 | A1* | 7/2011 | McKinley | A62B 23/025 128/863 |
| 2013/0291272 | A1 | 11/2013 | Bourque | |
| 2018/0160749 | A1* | 6/2018 | Kim | A41D 13/1107 |
| 2018/0280758 | A1 | 10/2018 | Tao | |

FOREIGN PATENT DOCUMENTS

| | | | | | |
|---|---|---|---|---|---|
| CN | 203884739 | U | * | 10/2014 | A41D 13/11 |
| CN | 203884742 | U | | 10/2014 | |
| CN | 203884745 | U | | 10/2014 | |
| CN | 103876353 | B | | 5/2015 | |
| CN | 104921341 | A | | 9/2015 | |
| CN | 104970460 | A | | 10/2015 | |
| CN | 205337712 | U | | 6/2016 | |
| CN | 205337713 | U | | 6/2016 | |
| CN | 105495777 | B | | 3/2017 | |
| CN | 106723522 | A | | 5/2017 | |
| CN | 106798985 | A | | 6/2017 | |
| CN | 206350864 | U | | 7/2017 | |
| CN | 206371550 | U | * | 8/2017 | A41D 13/11 |
| CN | 207428479 | U | | 6/2018 | |
| CN | 108936888 | A | | 12/2018 | |
| CN | 209185789 | U | | 8/2019 | |
| CN | 209331222 | U | | 9/2019 | |
| CN | 210250830 | U | | 4/2020 | |
| CN | 210250830 | U | * | 4/2020 | A61M 16/06 |
| KR | 20110007565 | A | | 1/2011 | |
| KR | 20110003053 | U | | 3/2011 | |
| TW | M378000 | U1 | | 4/2010 | |
| WO | 2013/085266 | A1 | | 6/2013 | |

OTHER PUBLICATIONS

尹嘉铖，姚旭 (Yin J, Yao X), "A kind of medical mask", Nov. 2016, All pages (Year: 2016).*

王雪娇，裘英楠 (Wang X, Qiu Y), "Department of respiration uses totally closed respiratory mask", May 2019, All pages (Year: 2019).*

Ball, Jessica, "Masks You Can Drink Through Are Popping Up Everywhere, But Are They Actually Effective?" EatingWell, [retrieved on Aug. 27, 2020]. Retrieved from the Internet <URL: https://www.eatingwell.com/article/7833534/are-masks-you-can-drink-through-effective/>.

Buckingham, Cheyenne, "This New Mask Allows You To Drink While Wearing It," [retrieved on Aug. 27, 2020]. Retrieved from the Internet <URL: https://www.eatthis.com/drinking-mask/#:~:text=mask%20of%202020%3A%20The%20Drinking,mouth%20is%20underneath%20the%20fabric.>.

Cain, Brenda, "Wondering how to eat, drink while staying protected from coronavirus? Check out these masks," [retrieved on Aug. 27, 2020]. Retrieved from the Internet <URL: https://www.cleveland.com/coronavirus/2020/06/wondering-how-to-eat-drink-while-staying-protected-from-coronavirus-check-out-these-masks.html>.

'ERIUAES Adult Cotton Dustproof and Windproof Outdoor Eye Protection Detachable with Zipper Opening Design Highly Filtered Air,' Amazon, [retrieved on Aug. 27, 2020]. Retrieved from the Internet <URL: https://www.amazon.com/ERIUAES-Dustproof-Windproof-Protection-Detachable/dp/B08D66T382/>.

"Face Mask With Zipper—Two Zipper Pulls To Adjust Open To Drink," StylemomDIY M, [retrieved on Aug. 27, 2020]. Retrieved from the Internet <URL: https://www.youtube.com/watch?app=desktop&v=5fUKIFoyMgg>.

'FIAYA Cotton 5 Face Masc with Zipper for Straw Face Reusable Mouth Protection For Riding Eating Drinking Camping Made In US,' Amazon, [retrieved on Aug. 27, 2020]. Retrieved from the Internet <URL:https://www.amazon.com/Fiaya%E3%80%90USA-Days%E3%80%91Reusable-Protection-Drinking-Camping/dp/B08BWM4TDQ>.

"Japan's Saizeriya restaurant 'develops' face mask to wear when eating," The Japan Times, [retrieved on Aug. 27, 2020]. Retrieved from the Internet <URL: https://www.japantimes.co.jp/news/2020/08/08/business/corporate-business/japan-saizeriya-restaurant-face-mask/>.

'KESIDGY Unisex Dustproof Drinking Face Guard with Hole for Straw for Adult and Children, Washable and Durable,' Amazon, [retrieved on Aug. 27, 2020]. Retrieved from the Internet <URL: https://www.amazon.in/Dustproof-Drinking-Children-Washable-Durable/dp/B08FGB28WZ>.

Kraus, Tamara, "The 15 Most Innovative Drinking Face Masks For Safer Sipping," SheKnows Media, [retrieved on Aug. 27, 2020]. Retrieved from the Internet <URL: https://www.sheknows.com/living/slideshow/2297475/best-drinking-face-masks/1/>.

Miller, Cody, "Company develops new face mask that lets you eat, drink without taking it off," News 3LV, [retrieved on Aug. 27, 2020]. Retrieved from the Internet <URL: https://news3lv.com/news/local/company-develops-new-face-mask-that-lets-you-eat-drink-without-taking-it-off>.

"New DIY Face Mask With Invisible Zipper/How To Sew Invisible Zipper To Face Mask," StylemomDIY M, [retrieved on Aug. 27, 2020]. Retrieved from the Internet <URL: https://www.youtube.com/watch?app=desktop&v=V1WtSeyBisA>.

Olvera, Kaitlyn, "Company Selling Masks With Zippers To Make Eating And Drinking Easier," KXAN-TV, [retrieved on Aug. 27, 2020]. Retrieved from the Internet <URL: https://www.kxan.com/news/weird-news/company-selling-masks-with-zippers-to-make-eating-and-drinking-easier/>.

"Redee Launches Innovative Safe-Drinking Face Mask Amidst Covid-19," CISION PR Newswire, [retrieved on Aug. 27, 2020]. Retrieved from the Internet <URL: https://www.prnewswire.com/news-releases/redee-launches-innovative-safe-drinking-face-mask-amidst-covid-19-301112690.html>.

'SENTMOON Summer Breathable Floral Printed Face Drinking Bandanas Facial Scarf Reusable Face Fabric with Hole for Straw,' Amazon, [retrieved on Aug. 27, 2020]. Retrieved from the Internet <URL: https://www.amazon.com/Sentmoon-Breathable-Drinking-%F0%9D%93%9C%F0%9D%93%90%F0%9D%93%A2%F0%9D%93%9As-Bandanas/dp/B08BRGP5SV/>.

"This New Mask Allows You To Eat Without Having To Take The Face Cover Off," News18, [retrieved on Aug. 27, 2020]. Retrieved from the Internet <URL: https://www.news18.com/news/buzz/this-new-mask-allows-you-to-eat-without-having-to-take-the-face-cover-off-2626355.html>.

"Velcro Mask Allows Diners To 'Eat, Drink And Be Social'," CBS Boston, [retrieved on Aug. 27, 2020]. Retrieved from the Internet <URL: https://www.youtube.com/watch?app=desktop&v=CawGZv7vQ1Y>.

'WTA Face Bandanas with Eyes Shield (PVC) with Drinking Straws Perforated, Cloth Covering for Face, Full Protection, Anti-Haze Dust, Washable, for Kids, Indoors and Outdoors,' Amazon, [retrieved on Aug. 27, 2020]. Retrieved from the Internet <URL: https://www.amazon.com/Reusable-Breathable-Perforated-Protection-Anti-Haze/dp/B08B8YCW4F/>.

* cited by examiner

RESPIRATORY MASK

BACKGROUND OF THE INVENTION

Field of the Invention

The present invention relates to a respiratory mask, and more particularly to a respiratory mask allowing the user or wearer to eat and drink while still providing protection to both the user and people in proximity of the user.

Description of the Prior Art

Typically, viruses such coronaviruses and those that cause the common cold and influenza can be spread by way of airborne particulates emitted from human respiratory tracts. Countless other contaminants and germs are also in the air that humans breathe. Breathing in such viruses or other contaminants can result in infectious diseases such as coronavirus disease, the common cold, influenza, bronchitis, pulmonary tuberculosis, and many other respiratory tract infectious diseases. Various masks have been developed for covering users' noses and/or mouths to prevent the users from both inhaling such viruses, germs, contaminants, and the like, and from ejecting the same into the local atmosphere.

Typical masks are normally made of one or more layers of woven or non-woven materials, and include some means to secure the mask to the user's face, such as one or more elastic bands that are intended to wrap around the user's head or face. When a user desires to eat or drink or otherwise provide unhindered access to the user's mouth, the typical mask must be removed from the user's face. As a result, the mask no longer provides any protection for the user, or those individuals near the user, from airborne contaminants.

The present invention can mitigate and/or prevent the foregoing problems associated with typical respiratory masks.

SUMMARY OF THE INVENTION

The present invention can provide a respiratory mask including a covering that can suitably filter viruses, germs, contaminants, and the like, yet selectively allow the user to freely eat and drink or otherwise provide access to his or her mouth.

The above, and other objects, features and advantages of the present invention will be apparent in the following detailed description of illustrative embodiments thereof, which is to be read in connection with accompanying drawings.

DETAILED DESCRIPTION OF THE PREFERRED EMBODIMENTS

Figure 1:
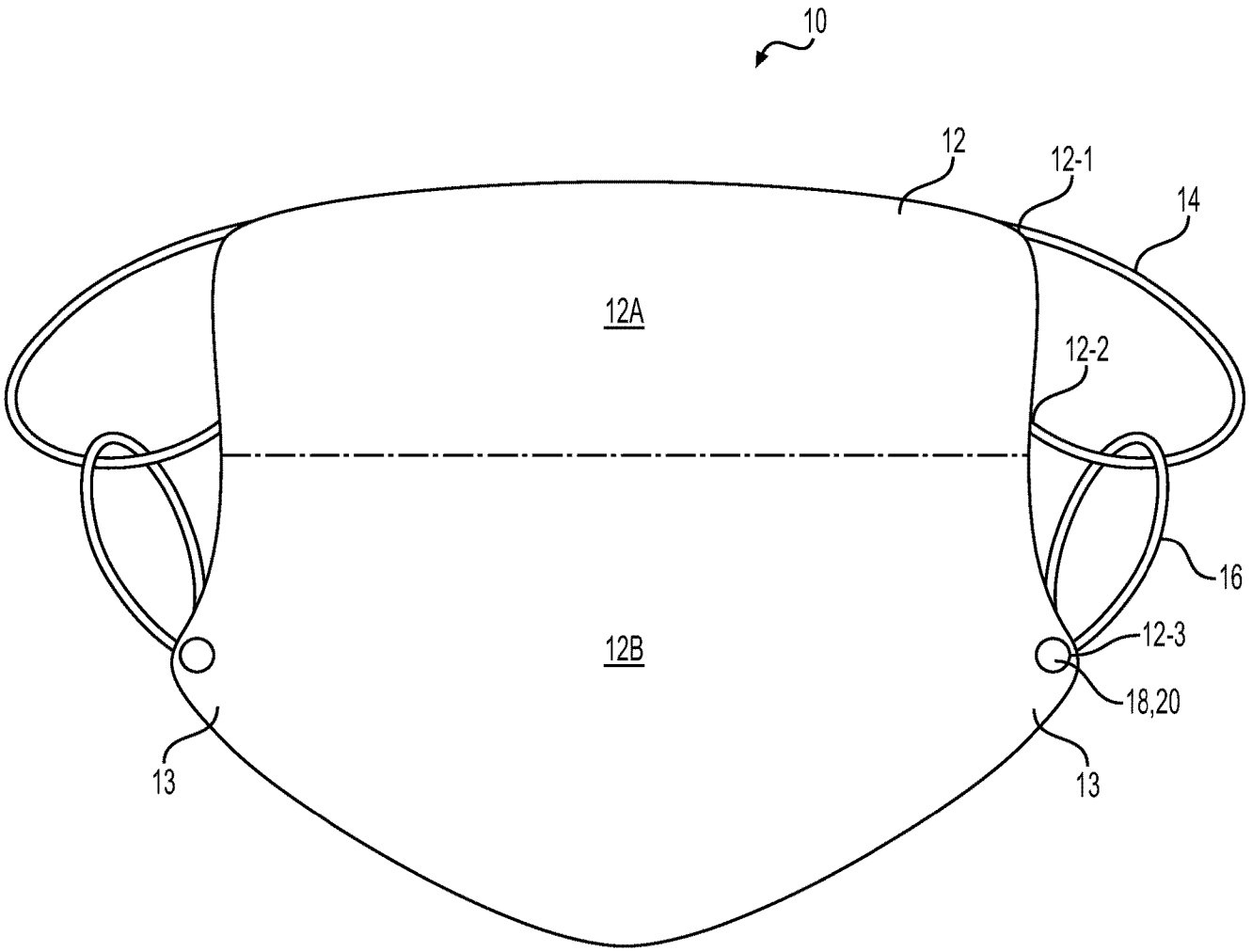
FIG. 1 is a view of a first embodiment of mask in accordance with the present invention, illustrating the bands fully connected.
Figure 2:
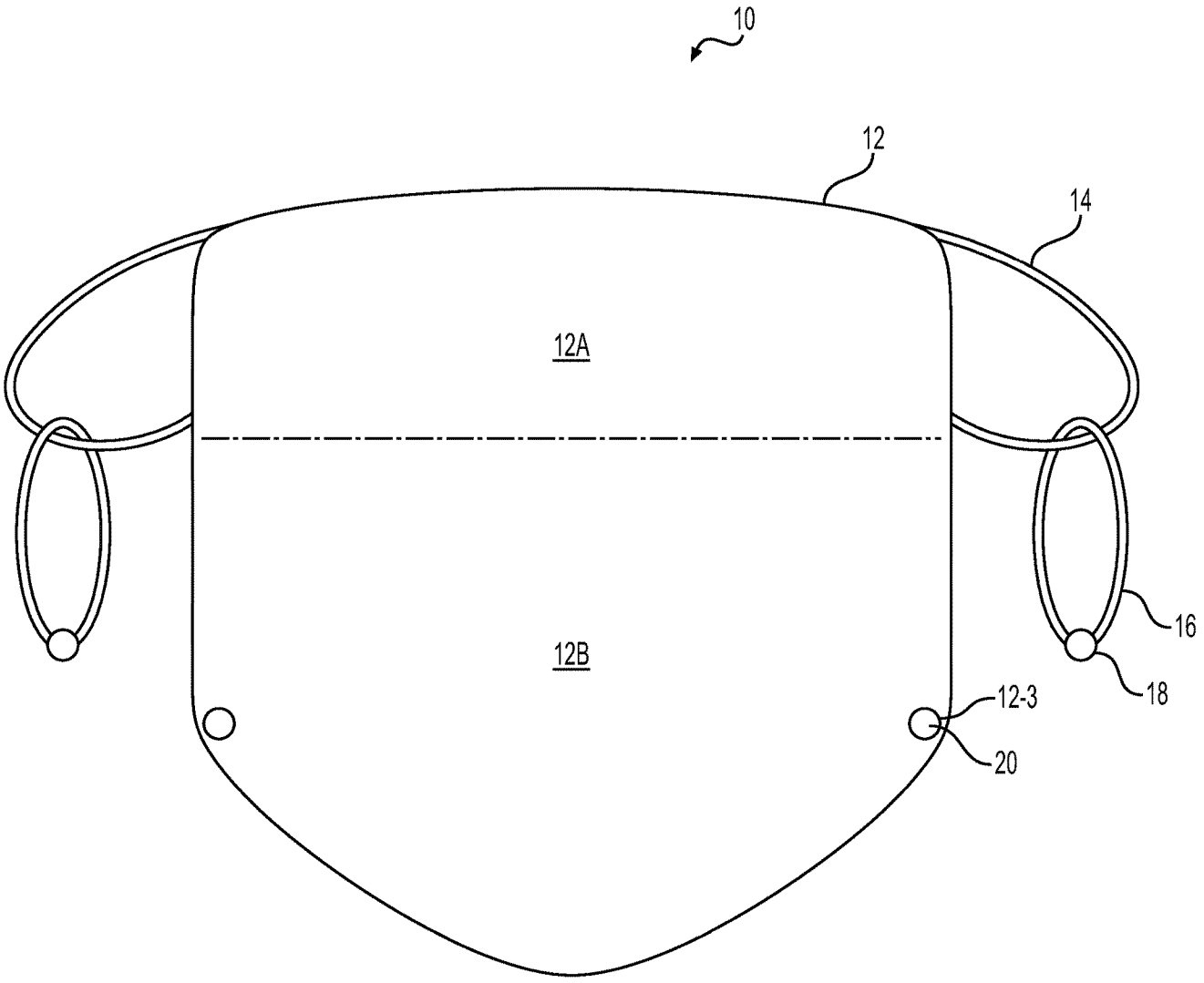
FIG. 2 is a view of the first embodiment of mask in accordance with the present invention, illustrating the bands being disconnected.

Referring to the drawings, and initially to FIGS. 1 and 2, a respiratory mask 10 in accordance with the present invention includes a covering 12 formed of one or more layers of woven or non-woven materials. The covering is made of any suitable material, such as a fabric, that is typically used to make respiratory masks. The covering is designed to fully cover the wearer's nose and mouth to provide respiratory protection for the wearer and prevent droplets and particulates of saliva and expectorate or other contaminants from projecting into the surrounding air should the wearer cough, sneeze, or otherwise expel air or other fluid. To that end, the covering can be any suitable shape, such as a rectangle or a shape that conforms to the general shape of the user's face. Covering 12 can be described as having two regions, an upper, nose-covering region 12A and a lower, mouth-covering region 12B. While the upper and lower regions are not necessarily discrete sections, the upper region is intended to cover the user's nose and the lower region is intended to cover the user's mouth. As shown, upper region 12A is generally rectangular in shape to cover the user's cheeks, nose, and upper lip and lower region 12B is tapered so as to conform to and cover the user's mouth and chin. This tapered shape can be achieved by providing flared regions 13 at the sides of lower region 12B in a symmetrical manner.

Mask 10 includes bands 14, 16 for securing covering 12 to the user's head so as to securely cover the user's nose and mouth. Bands 14, 16 are secured to covering 12 at least at six connection points, that is, at least three connection points 12-1, 12-2, 12-3 on each side. Connection points 12-1 and 12-2 are disposed generally at four corners of upper region 12A and connection points 12-3 are disposed at edges of lower region 12B. If the lower region 12B is tapered, connection points 12-3 are preferably located at flared regions 13. Bands 14 are secured to covering 12 at connection points 12-1 and 12-2 in any known manner such that the connections are not releasable. Conversely, bands 16 are secured to covering 12 at connection points 12-3 in any known manner using connector 18 on covering 12 and complementary connector 20 on band 16 such that the connections at connection points 12-3 are releasable. This releasability can be achieved in any known manner using connector pair 18, 20. As non-limiting examples, connector pair 18, 20 can be one of buttons and buttonholes, male and female snaps or studs, hook and loop materials (Velcro™), clasps, etc. Bands 14 can be fitted over the wearer's ears or around the wearer's head. Each of bands 16 is secured to a corresponding band 14.

In the shown embodiment, two bands 14 are provided in the form of loops on both sides of covering 12 so that they can be looped over the user's ears when worn. The present invention is not limited to this design and any form of bands 14 is suitable as long as bands 14 are connected to covering 12 at two or more points on each side and can be readily secured to the user's head. An alternate design can entail, for example, a single integral band 14 with a unitary main strip that bifurcates at its ends to provide the two connections on each side. In this design, the single band would be wrapped around the back of the user's head when worn, rather than be looped around his or her ears. In a further alternative, the single integral band need not be bifurcated, but rather can be a continuous band similar to a balaclava or gaiter, but with the lower region being detachable from the covering section. Also, in the shown embodiment, bands 16 are shown as loops interconnected with corresponding bands 14 on each side. The present invention is also not limited to this design and any form of bands 16 is suitable as discussed in more detail below. Bands 14, 16 can be made of any suitable elastic material, but need not necessarily be elastic. If any known releasable device (e.g., a buckle, snaps, hook-and-loop material, or even a tied knot) is employed to releasably secure the bands to the user's head, the bands can be non-elastic.

In use, for maximum protection, a user secures covering 12 to bands 16 at lower connection points 12-3 using complementary connectors 18, 20 such that the mask 10 is fully connected as shown in FIG. 1. Then the user places the loops of bands 14 around his or her ears such that region 12A is securely held over the user's nose and region 12B is securely held over the user's mouth and chin. When the wearer would like to eat or drink or allow access to his or her mouth for any other reason, while still wearing the mask, the user detaches bands 16 at the lower connection points 12-3 as shown in FIG. 2 so that the lower region 12B of the covering 12 can hang or drape freely, allowing the user's mouth to be accessible. At the same time, the bands 14 remain attached at the other four connection points 12-1, 12-2 to snugly hold the upper region 12A over the user's nose. Even while draping, the lower region 12B of the covering can still provide some protection of the user's mouth and prevent particulates and droplets of expectorate and saliva, such as from a cough or sneeze by the user, from projecting outwardly.

In the shown embodiment, bands 14 and 16 are elastic and bands 16 are connected to bands 14 such that bands 16 are connected to the user's ears via bands 14. Also, in the shown embodiment, each band 16 is looped around a corresponding band 14 so as to allow relative movement between the two and allow the mask 10 to readily adjust to each individual user's head size and shape. In addition, the releasable connection is provided at the attachment points of the covering 12 and bands 14. The present invention is not limited to these specific designs. For example, bands 16 need not be connected to the user through bands 14, but can be attached directly to the user's ears or share a common connection with bands 16 near the user's ears. Further, bands 16 can be securely connected to bands 14, or can be releasably connected thereto. In that regard, the releasable connection using connectors 18, 20 need not necessarily be at connection points 12-3, but can be disposed anywhere between connection point 12-3 and the user's head. For example, the releasable connection can be provided where band 16 is connected to band 14 or, if band 16 directly connects to the user's ear, at that point.

Figure 3:
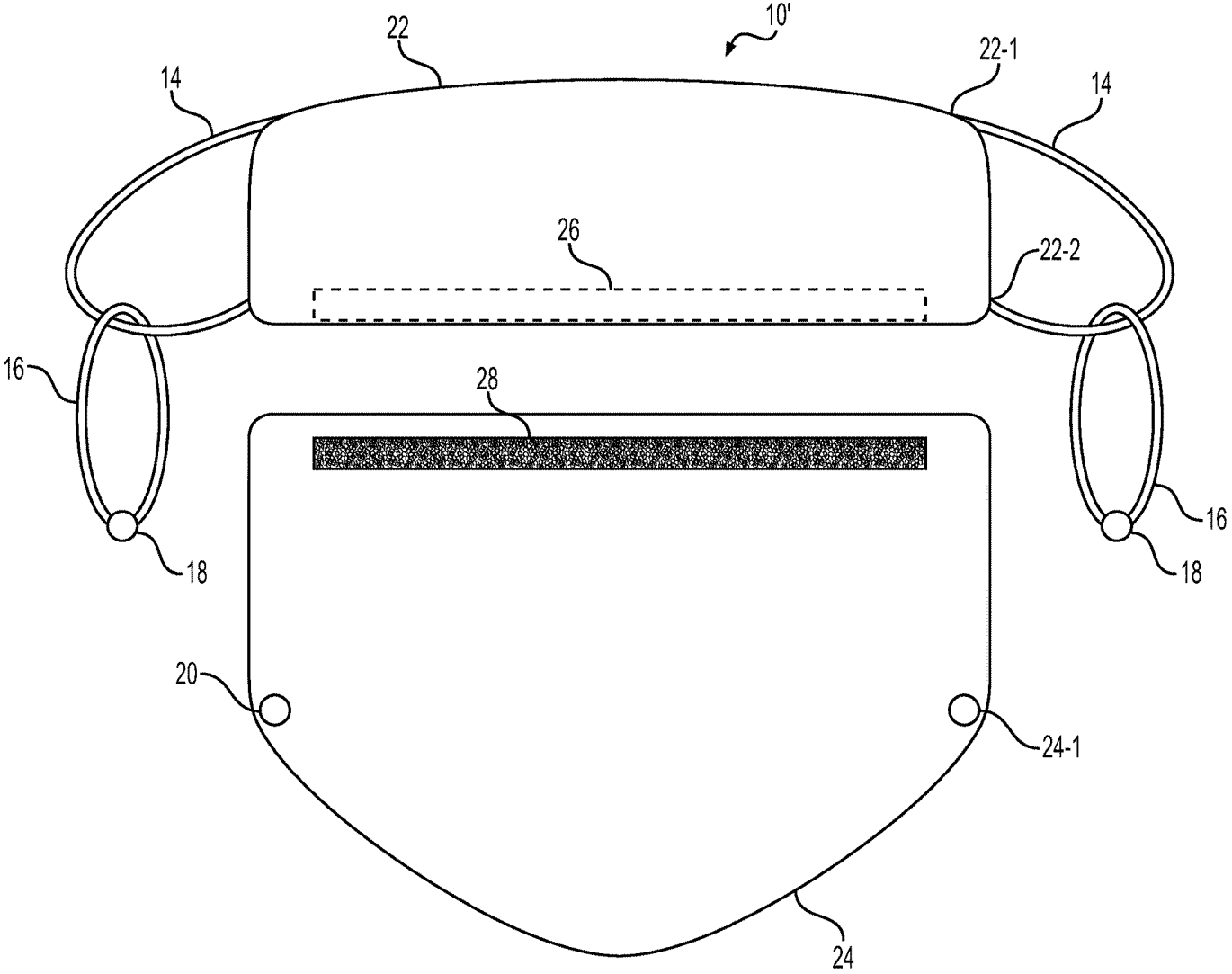
FIG. 3 is a view of a second embodiment of mask in accordance with the present invention, illustrating the upper and lower mask coverings detached and the bands disconnected.
Figure 4:
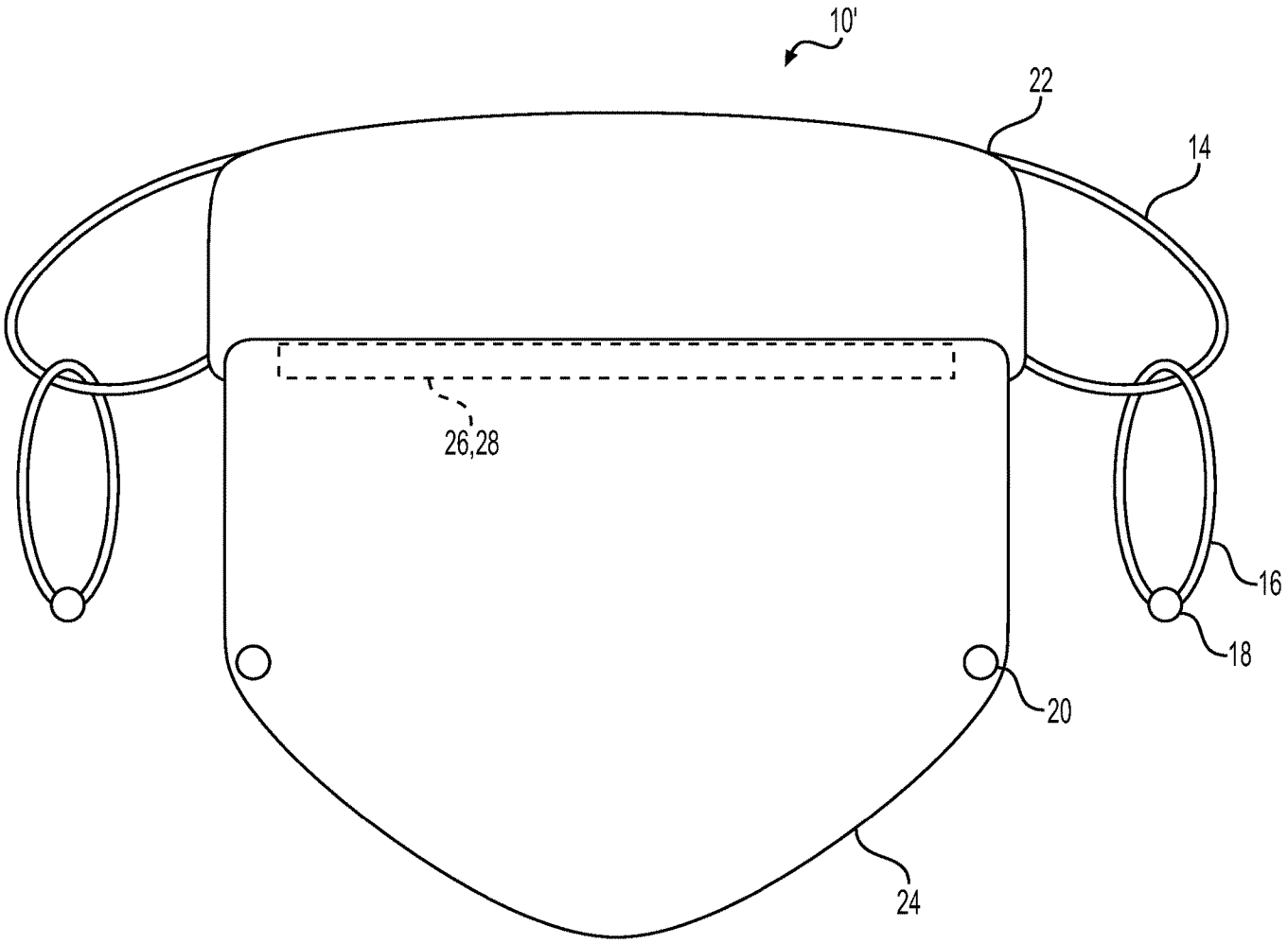
FIG. 4 is a view of the second embodiment of mask in accordance with the present invention, illustrating the upper and lower mask coverings attached and the bands disconnected.

A second embodiment is shown in FIGS. 3 and 4. Elements that are similar to those in the first embodiment are assigned the same reference numerals and will not be further described hereafter. In the second embodiment, the covering is formed of two discrete parts, an upper covering 22 and a lower covering 24. Similar to the upper and lower regions in the first embodiment, upper covering 22 is intended to cover the user's nose and lower covering 24 is intended to cover the user's mouth. Also similar to the first embodiment, upper covering 22 is generally rectangular in shape to cover the user's cheeks, nose, and upper lip and lower covering 24 is tapered so as to conform to and cover the user's mouth and chin. Upper covering is connected at its upper and lower corners to bands 14 at connection points 22-1, 22-2, and lower covering 24 part is connected at its lower side edges to bands 16 at connection points 24-1. The upper edge on one side of lower covering 24 and the lower edge on an opposite side of upper covering 22 are releasably connected by any suitable means, such as hook and loop (Velcro™) strips 26, 28, preferably running the full length of the edges. This can allow the wearer to partially or fully (See FIG. 3) separate the upper and lower coverings 22, 24. When partially separated, a hole or gap is formed between the two coverings 22, 24 to allow limited access to the user's mouth, so as to insert a straw, for example. The lower covering 24 can be released from band 16 as in the first embodiment so as to allow the lower covering to drape while providing full protection of the user's nose by the upper covering 22. Also, when detached from bands 16, lower covering 24 can be detached at the releasable connection 26, 28 and fully removed from the user's face while still wearing the upper covering 22.

Further modifications can be made to the embodiments described above. For example, while the lower region is intended to drape over the user's mouth when disconnected from bands 16, a device can be associated with the lower region 12B or lower covering 24 to urge the lower region or covering away from the user's mouth to allow freer access. This device can be in the form of a relatively weak, elongated elastic spring or strut integrated vertically along the edges or middle of the lower region 12B or lower covering 24. When bands 16 are released from the covering, the spring or strut is designed to straighten and flex outwardly to urge the lower region or covering away from the user's mouth, but not too far beyond vertical orientation, so as to still be disposed in front of the user's mouth in the horizontal direction. This design can also keep the lower region or covering away from the user's mouth even if the user's head moves abruptly or he or she is hit with a breeze when bands 16 are detached. As another modification, the bottom of the lower region 12B or lower covering 24 can be weighted to allow the lower region or covering to hang vertically when bands 16 are released. The weighting can be implemented by integrating weighted member(s) near the lower edge of the lower region or covering or even making connectors 18 weighted to have a dual purpose. As with the previous modification, the weighting can aid in keeping the lower region or covering away from, but still in front of, the user's mouth.

Although illustrative embodiments of the present invention have been described herein with reference to the accompanying drawings, it is to be understood that the invention is not limited to those precise embodiments, but that various changes and modifications can be made thereto by those skilled in the art without departing from the scope or spirit of this invention.

What is claimed is:

1. A mask for covering a user's face, the mask comprising:

covering material for covering at least a portion of the user's face, including the user's nose and mouth, the covering material including an upper section and a lower section;

a band system for holding the covering material against the user's face, the band system including a main band having at least one main band strap for attachment to two points of contact along each of side edges of the upper section of the covering material, and a lower band having at least one lower band strap for attachment to the lower section of the covering material at one point of contact, wherein the at least one main band strap remains attached at all times to each of the side edges of the upper section at the two points of contact while the mask is worn by the user, the at least one main band strap holding the upper section of the covering material against the user's face while the mask is worn by the user, and the user maintains connection of the at least one lower band strap when the lower section of the covering material is to be closely held against the user's face while the mask is worn by the user, and the user releases connection of the at least one lower band strap when the lower section of the covering material is to hang freely in front of the user's face while the mask is worn by the user.

2. The mask according to claim 1, wherein the at least one lower band strap includes connectors for releasable connection of the lower band strap to the lower section of the covering material.

3. The mask according to claim 2, wherein the connectors each include a button or buttonhole, hook-and-loop material, or a snap.

4. The mask according to claim 2, wherein the at least one lower band strap comprises two lower band straps, each connectable to both the lower section of the covering material and the at least one main band strap.

5. The mask according to claim 4, wherein the connectors are provided at an end of each lower band strap for releasable connection to the lower section of the covering material.

6. The mask according to claim 4, wherein the connectors are provided at an end of each lower band strap for releasable connection to the at least one main band strap.

7. The mask according to claim 1, wherein the at least one main band strap comprises two main band straps for connection to the user's ears.

8. The mask according to claim 1, wherein the upper section of the covering material is configured to closely cover the user's nose region while the mask is worn by the user, and the lower section of the covering material is configured to closely cover the user's mouth region while the mask is worn by the user and the at least one lower band strap is in a connected state, and to hang freely in front of the user's mouth region while the mask is worn by the user and the at least one lower band strap is in a disconnected state.

9. The mask according to claim 1, wherein the lower section of the covering material includes flared regions at both sides, the at least one lower band strap being attached to the lower section of the covering material at the flared regions.

10. The mask according to claim 1, wherein when the connection of the at least one lower band strap is released when the lower section of the covering material is to hang freely in front of the user's face while the mask is worn by the user, the upper section of the covering material is snugly held over the user's nose region.

11. A method for covering at least a portion of a user's face, including the user's nose and mouth, with a mask, the mask including a covering material having an upper section and a lower section, and a band system for holding the covering material against the user's face, the band system including a main band having at least one main band strap for attachment to two points of contact along each of side edges of the upper section of the covering material and a lower band having at least one lower band strap for attachment to the lower section of the covering material at one point of contact, the at least one main band strap remaining attached at all times to each of the side edges of the upper section at the two points of contact, the method comprising:

securing the at least one main band strap to the user's head such that the at least one main band strap holds the upper section of the covering material against the user's face; and selectively i) maintaining connection of the at least one lower band strap when the lower section of the covering material is to be closely held against the user's face while the mask is worn by the user, and ii) releasing connection of the at least one lower band strap when the lower section of the covering material is to hang freely in front of the user's face while the mask is worn by the user.

12. The method according to claim 11, wherein selectively maintaining and releasing connection of the at least one lower band strap is performed with releasable connectors.

13. The method according to claim 12, wherein the connectors each include a button or buttonhole, hook-and-loop material, or a snap.

14. The method according to claim 12, wherein the at least one lower band strap comprises two lower band straps, each connectable to both the lower section of the covering material and the at least one main band strap.

15. The method according to claim 14, wherein the connectors are provided at an end of each lower band strap for releasable connection to the lower section of the covering material.

16. The method according to claim 14, wherein the connectors are provided at an end of each lower band strap for releasable connection to the at least one main band strap.

17. The method according to claim 11, wherein the at least one main band strap comprises two main band straps for connection to the user's ears.

18. The method according to claim 11, further comprising closely covering the user's nose region with the upper section of the covering material, and either i) closely covering the user's mouth region with the lower section of the covering material by maintaining the at least one lower band strap in a connected state, or ii) allowing the lower section of the covering material to hang freely in front of the user's mouth region while the mask is worn by the user by placing the at least one lower band strap in a disconnected state.

19. The method according to claim 11, wherein the lower section of the covering material includes flared regions at both sides, the at least one lower band strap being attached to the lower section of the covering material at the flared regions.

20. The method according to claim 11, wherein when the connection of the at least one lower band strap is released when the lower section of the covering material is to hang freely in front of the user's face while the mask is worn by the user, the upper section of the covering material is snugly held over the user's nose region.

* * * * *